US007458113B2

(12) United States Patent
Milam

(10) Patent No.: US 7,458,113 B2
(45) Date of Patent: Dec. 2, 2008

(54) PATIENT WINCH

(76) Inventor: Angela Milam, 271 Chambers Rd., Macon, GA (US) 31217

( * ) Notice: Subject to any disclaimer, the term of this patent is extended or adjusted under 35 U.S.C. 154(b) by 341 days.

(21) Appl. No.: 11/381,533

(22) Filed: May 3, 2006

(65) Prior Publication Data

US 2006/0273292 A1 Dec. 7, 2006

Related U.S. Application Data

(60) Provisional application No. 60/678,755, filed on May 6, 2005.

(51) Int. Cl.
*A61G 7/10* (2006.01)

(52) U.S. Cl. ..... 5/81.1 HS; 5/81.1 R; 5/503.1; 254/329; 254/343; 254/380

(58) Field of Classification Search ..... 5/81.1 HS, 5/81.1 R, 83.1, 85.1, 503.1; 254/329, 343, 254/380, 342, 323; 212/179
See application file for complete search history.

(56) References Cited

U.S. PATENT DOCUMENTS

| | | | | |
|---|---|---|---|---|
| 3,597,774 A | | 8/1971 | Warren | |
| 5,282,599 A | * | 2/1994 | Arpaia et al. | 248/311.2 |
| 5,737,781 A | | 4/1998 | Votel | |
| 5,890,238 A | | 4/1999 | Votel | |
| 6,247,674 B1 | * | 6/2001 | Jawidzik | 248/213.2 |
| 6,378,148 B1 | | 4/2002 | Votel | |
| 6,496,991 B1 | | 12/2002 | Votel | |
| 6,658,678 B2 | * | 12/2003 | Hotaling et al. | 5/503.1 |
| 6,728,979 B1 | | 5/2004 | Robert | |
| 6,772,456 B2 | | 8/2004 | Votel | |
| 2004/0221388 A1 | | 11/2004 | Votel | |

* cited by examiner

*Primary Examiner*—Alexander Grosz
(74) *Attorney, Agent, or Firm*—QuickPatents, Inc.; Kevin Prince

(57) ABSTRACT

A winch for moving a patient laying on a pad is disclosed. The winch includes an enclosure that has a winching mechanism fixed within the enclosure, a power means, a motor, a gearing means, a power switching means, and a spool means. Preferably the winch further includes a bedrail hook attached to the front wall, the hook comprising at least one rigid U-shaped member. As such, the enclosure may be fixed to a bedrail of a bed to move the patient laying on the pad on the bed. A winching strap is connected at one end thereof to the spool means. The winching strap traverses an aperture in the at least one side wall of the enclosure, and a distal end of the winching strap terminates in a pad clamping means. The pad clamping means is preferably a clamping bar having at least two clamps, such that when the winching mechanism pulls the clamps towards the enclosure the clamps are further tightened upon the pad. In use, the pad clamping means is clamped firmly to the pad, and with the enclosure secured to a non-movable object, the winching mechanism may be activated by applying power thereto to retract the winching strap around the spool means to move the patient.

13 Claims, 5 Drawing Sheets

PATIENT WINCH

CROSS-REFERENCE TO RELATED APPLICATIONS

This application claims the benefit of U.S. Provisional Patent Application 60/678,755, filed on May 6, 2005.

STATEMENT REGARDING FEDERALLY SPONSORED RESEARCH AND DEVELOPMENT

Not Applicable.

FIELD OF THE INVENTION

This invention relates to winches, and more particularly to a winch particularly adapted to moving a patient lying on a bed.

DISCUSSION OF RELATED ART

Health care workers often have difficulty moving patients laying in a hospital bed, or moving patients from one bed to another, particularly with heavy patients. It often takes several health care workers to move an unconscious or otherwise incapacitated patient from one bed to another, or to reposition a patient. As a result, to avoid injury to health care workers when having to move a patient in such a manner, there have been several prior art devices design to assist health care workers.

The earliest such patient moving devices were manual winches, such as that disclosed in U.S. Pat. No. 3,597,774 to Warren on Aug. 10, 1971. Such devices improve the leverage that a health care worker has in terms of moving a patient, yet such device must still be actuated manually by the health care worker. A single health care worker, however, often has difficulty both actuating such a device and keeping the patient stabilized and any blankets or pads upon which the patient is resting straight and unfolded. Further, particularly with heavy patients, some health care workers still do not have the strength to manually move such patients themselves.

Other winch devices, mechanically assisted with electric motors, have been devised to overcome these aforementioned disadvantages. For example, U.S. Pat. No. 6,772,456 to Votel on Aug. 10, 2004, discloses such a device incorporated into a hospital bed. Such a device, however, is not often required for any particular patient, and as such most of the time such a device is unused. As such, the cost of such a hospital bed is greatly increased, and many such beds must be purchased. Clearly us a device, while it may succeed in allowing a health care worker to single handedly move a patient, is not very practical in an era when hospitals are seeking to reduce costs.

Other prior art motor-assisted winch devices provide transportable devices that can typically be rolled-up to existing hospital beds or other patient platforms and secured thereto. Such devices are taught in U.S. Pat. No. 6,496,991 to Votel on Dec. 24, 2002; U.S. 6,378,148 to Votel on Apr. 30, 2002; U.S. Pat. No. 6,728,979 to Robert on May 4, 2004; U.S. Pat. No. 5,737,781 to Votel on Apr. 14, 1998; and US Patent Application 2004/0221388 to Votel on Nov. 11, 2004. Such devices all have the drawback that they are bulky and difficult to transport and store. While such devices may be used with virtually any hospital bed or gurney, the device may be difficult to move from one location to another, particularly in a crowded situations such as in a battle field hospital or other cramped locations.

One prior art device, disclosed in U.S. Pat. No. 5,890,238 to Votel on Apr. 6, 1999, teaches a portable device for mounting on the bedrail of an existing hospital bed. Such a device succeeds in providing a more portable patient winch device, yet due to its relatively complex blanket attachment means and its relatively large winching mechanism enclosure it is still relatively bulky and difficult for some health care personnel to use. Further, the bedrail attachment means of such a device is essentially a long channel, which may or may not work with any particular bedrail, particularly curved bed rails.

Therefore, there is a need for an inexpensive and extremely portable patient winch device. Such a needed device would be mountable on various support structures, including any type of existing bedrail found on a hospital bed, gurney, other patient platform, or even walls. Such a needed device would be battery powered or AC line powered, making it equally convenient to use in hospital settings as well as outdoor emergency settings, or the like. The needed device would also be useful in conjunction with any particular patient blanket or bed sheet. The present invention accomplishes these objectives.

SUMMARY OF THE INVENTION

The present device is a winch for moving a patient laying on a pad. The winch includes an enclosure that includes a winching mechanism fixed within the enclosure, a power means, a motor, a gearing means, a power switching means, and a spool means. The power switching means preferably includes an on/off power switch and a three-way momentary direction switch that is normally in a central "off" position. Upon actuation in one direction or the other, the three-way switch powers the motor in either a forward or reverse direction. Upon releasing the switch, the motor is deactivated, thereby for safety forcing an operator to manually actuate the switch to activate the motor and making it impossible for the motor to be actuated without a human operator controlling the winch.

The power means is preferably an electric power cable terminating at a distal end in a pronged outlet plug for powering the winching mechanism by AC line power. In such an embodiment, the enclosure preferably includes a power cable holder projecting from the rear wall for allowing the power cable to be wound thereupon to facilitate transporting and storing of the winch. A carrying handle may be further include to further facilitate transporting and storing of the winch.

Preferably the winch further includes a bedrail hook attached to the front wall, the hook comprising at least one rigid U-shaped member. As such, the enclosure may be fixed to a bedrail of a bed to move the patient laying on the pad on the bed. A stability strap is preferably included that is attached at one end thereof to the enclosure, and attached at the other end thereof to a hook. As such, the hook may be engaged to the U-shaped member to secure the U-shaped member around the bedrail.

A winching strap is connected at one end thereof to the spool means. The winching strap traverses an aperture in the at least one side wall of the enclosure, and a distal end of the winching strap terminates in a pad clamping means. The pad clamping means is preferably a clamping bar having at least two clamps, such that the pulling force pulling the clamping means is distributed substantially equally across each clamp. Each clamp is preferably a cam-based clamp whereby the clamp is tightened further upon the pad when the clamp is pulled by the winching mechanism towards the enclosure.

The pad is released when the winching mechanism is deactivated and a lever of the clamp is actuated to release the pad.

In use, the pad clamping means is clamped firmly to the pad, and with the enclosure secured to a non-movable object, the winching mechanism may be activated by applying power thereto to retract the winching strap around the spool means. As a result, the patient is moved along a bed or the like. The winching strap may be extracted from the enclosure by activating the switch to draw-out the winching strap in the forward direction. The reverse direction is used to pull the patient towards the winch.

The present invention is an inexpensive and extremely portable patient winch device that is mountable on a wide variety of support structures, including any type of existing bedrail found on a hospital bed, gurney, or other patient platform. The present invention may be battery powered or AC line powered, making it equally convenient to use in hospital settings as well as outdoor emergency settings, or the like. The present device may be used with any particular patient blanket or bed sheet, as well as specially adapted pads specifically made to facilitate transferring of patients. Other features and advantages of the present invention will become apparent from the following more detailed description, taken in conjunction with the accompanying drawings, which illustrate, by way of example, the principles of the invention.

DETAILED DESCRIPTION OF THE PREFERRED EMBODIMENT

Figure 1:
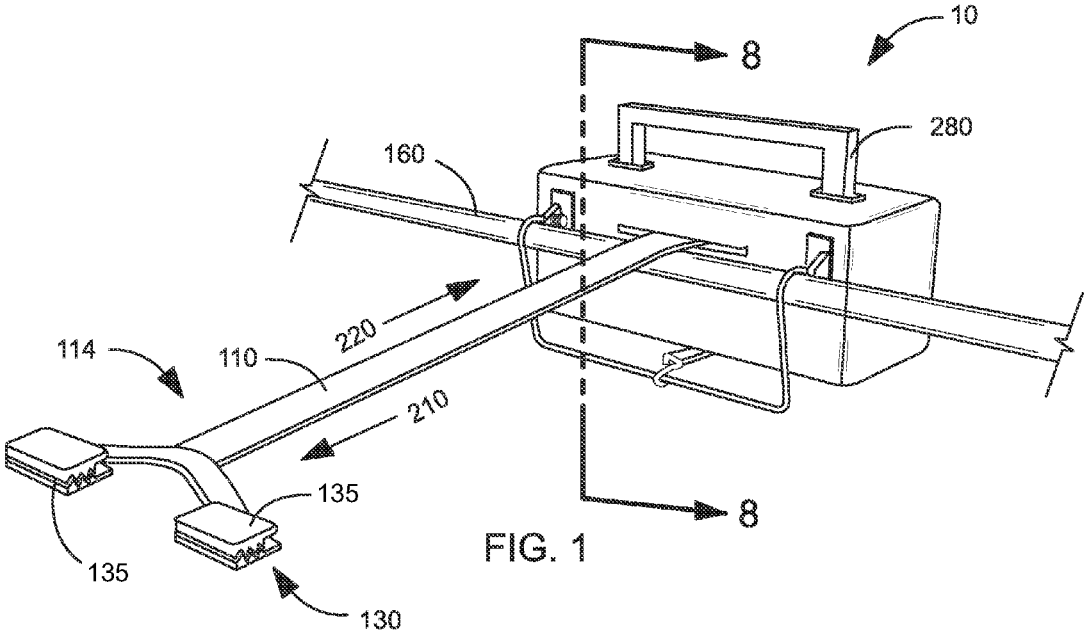
FIG. 1 is a perspective view of the invention, illustrating a winching strap extending from an aperture in an enclosure of the invention.
Figure 3:
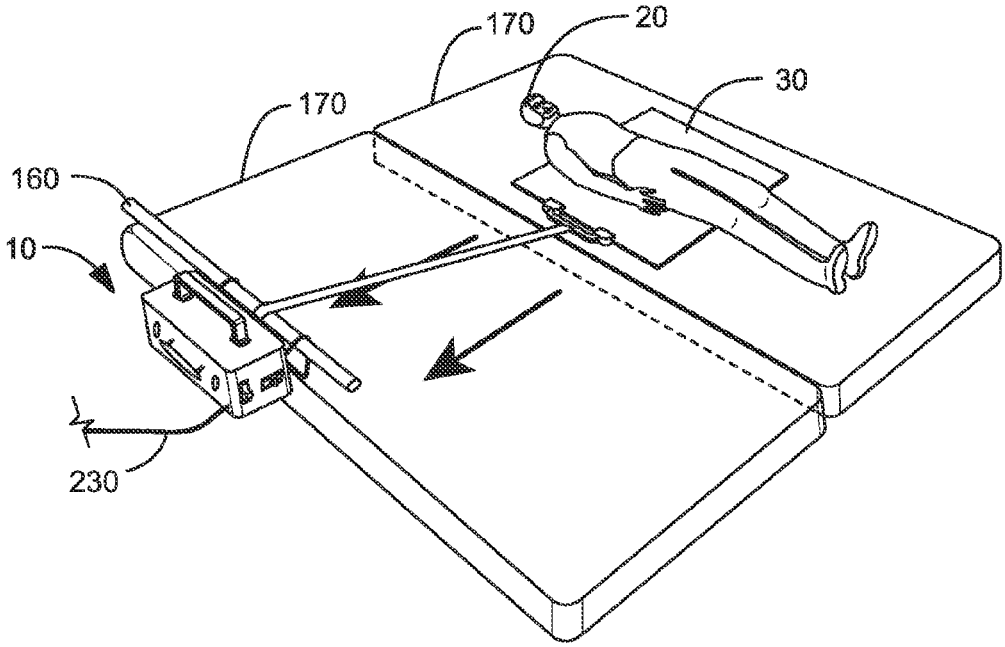
FIG. 3 is a top plan view of the invention, illustrating a patient to be moved from one bed to another bed by the present invention.
Figure 4:
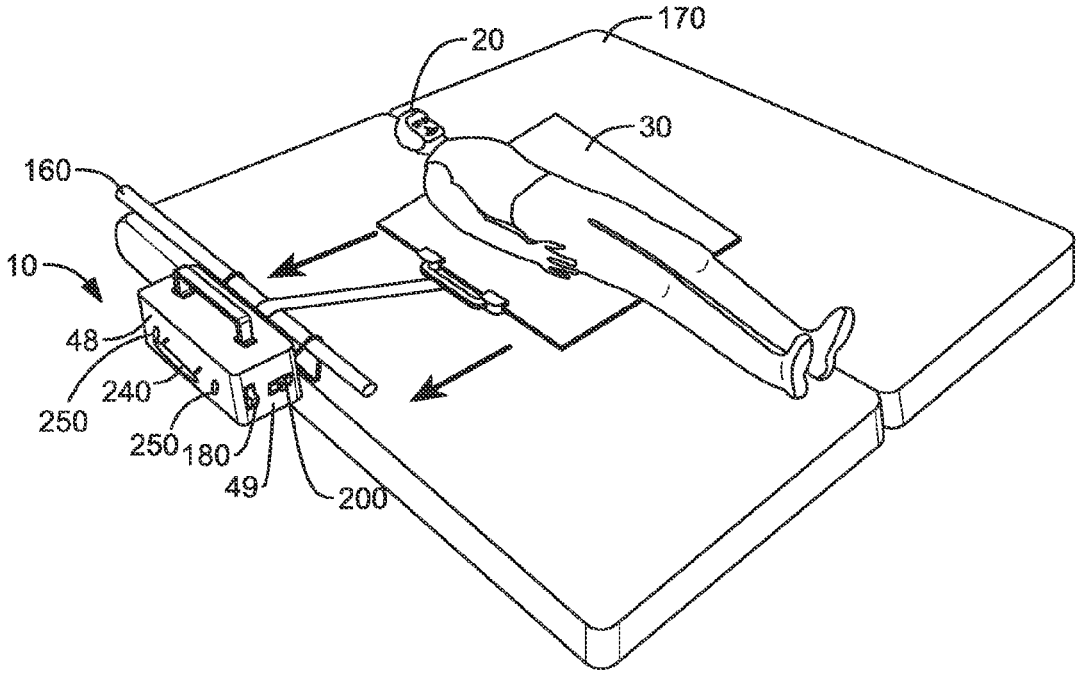
FIG. 4 is a top plan view of the invention, illustrating the patient as having been moved from the one bed to the other bed by the invention.
Figure 5:
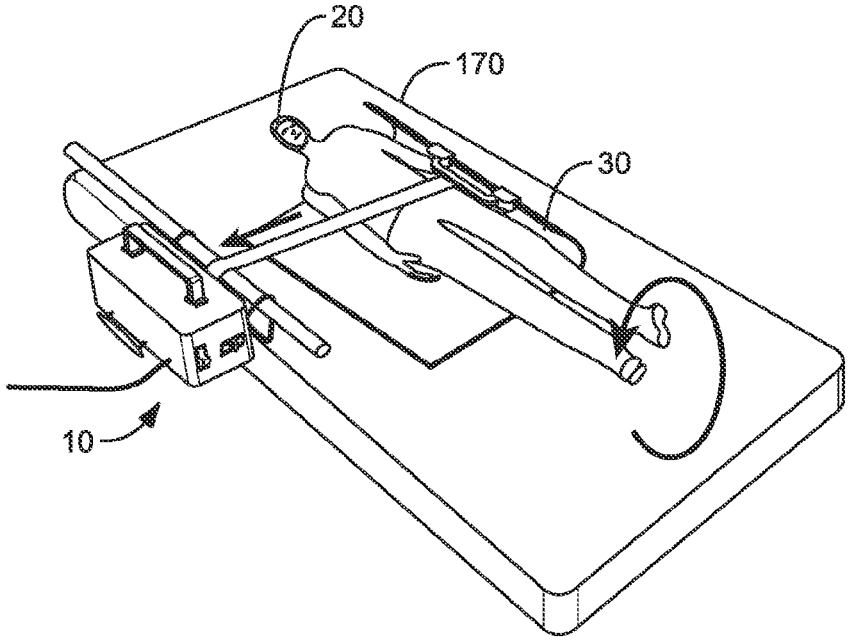
FIG. 5 is a top plan view of the invention, illustrating the patient as being rolled over with the present invention.
Figure 8:
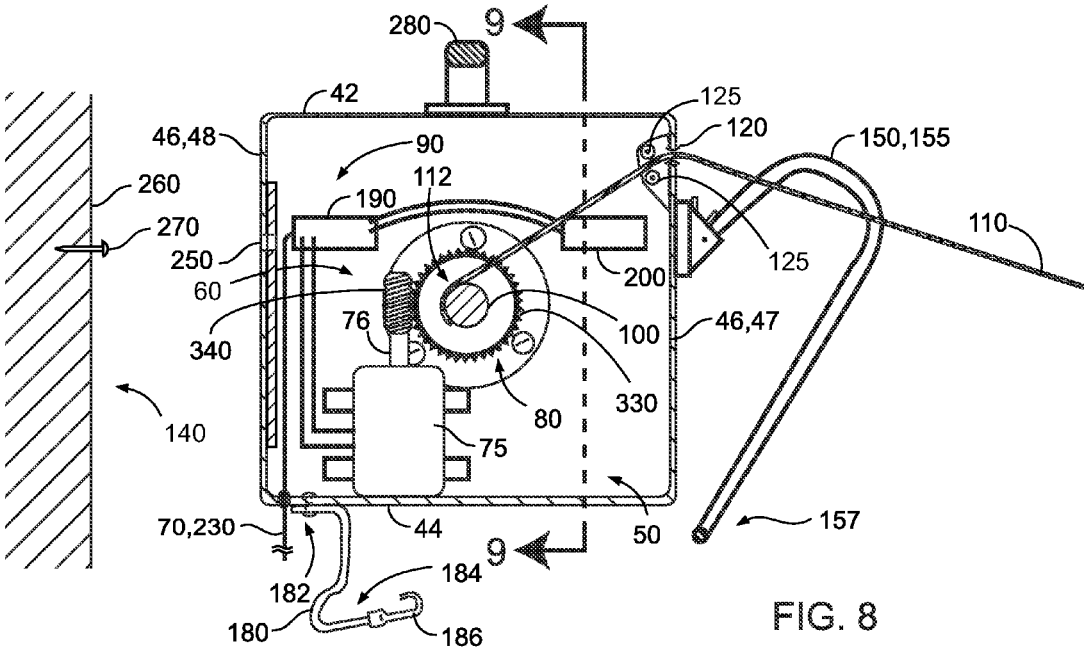
FIG. 8 is a cross-sectional view of the invention, taken generally along lines 8-8 of FIG. 1, illustrating a winching mechanism of the invention.
Figure 9:
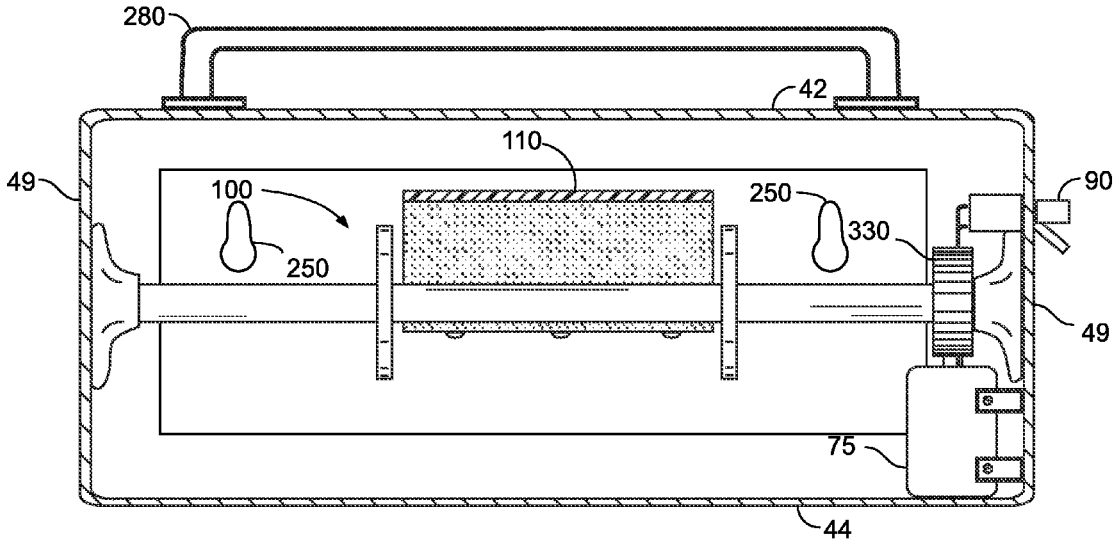
FIG. 9 is a cross-sectional view of the invention, taken generally along lines 9-9 of FIG. 8.

FIGS. 1 and 3 illustrate a winch 10 for moving a patient 20 laying on a pad 30. The winch 10 includes an enclosure 40 that includes a bottom wall 42, a top wall 44 and at least one side wall 46. The walls 42,44,46 define an internal space 50 within the enclosure 40 (FIGS. 8 and 9). Preferably the at least one side wall 46 comprises a front wall 47, a rear wall 48, and two lateral walls 49.

A winching mechanism 60 is fixed within the enclosure 40 and includes a power means 70, a motor 75, a gearing means 80, a power switching means 90, and a spool means 100, such as a reel. The power switching means 70 preferably includes an on/off power switch 190 and a three-way momentary direction switch 200 that is normally in an "off" position. Upon actuation in one direction or the other, the three-way switch 200 powers the motor 75 in either a forward 210 or reverse 220 direction (FIG. 1). Upon releasing the switch 200, the motor 75 is deactivated, thereby for safety forcing an operator to manually actuate the switch 200 to activate the motor 75 and making it impossible for the motor 75 to be actuated without a human operator controlling the winch 10.

The gearing means 80 preferably includes a worm gear 330 fixed to the spool means 100 and a worm 340 fixed to a shaft 76 of the motor 75. The motor 75 is positioned to drive the worm gear 330 in either a forward or reverse direction with a high gearing ratio so as to facilitate the high-torque movement required of the spool means 100 to move even heavy patients 20. Clearly, however, other gearing means 80 may be used, as will be evident by those skilled in the art. Further, spool means 110 may be any variety of spindles that serve the purpose of allowing the winding of the winching strap 110 when the winching strap 110 is fully retracted inside the enclosure 40. Take-up wheels 125 may be further included, and may be mechanically connected to the gearing means 80 (not shown) to take-up any slack of the winching strap 110 when extending the winching strap 110 from within the enclosure. As such, slack in the winching strap 110 will not accumulate within the enclosure 40 when extending the winching strap 110 in the forward direction 210.

The power means 70 is preferably an electric power cable 230 terminating at a distal end 232 in a pronged outlet plug 234 for powering the winching mechanism 60 by AC line power. In such an embodiment, the enclosure 40 preferably includes a power cable holder 240 projecting from the rear wall 48 for allowing the power cable 230 to be wound thereupon to facilitate transporting and storing of the winch 10. A carrying handle 280 may be further include to further facilitate transporting and storing of the winch 10. Alternately, the power means 70 may be a battery (not shown) such that the winch 10 may be utilized in an area located away from an AC power source. Such a battery would be a low voltage battery with relatively high current capacity in order to move even heavy patients 20 yet not pose a high-voltage risk.

Figure 2:
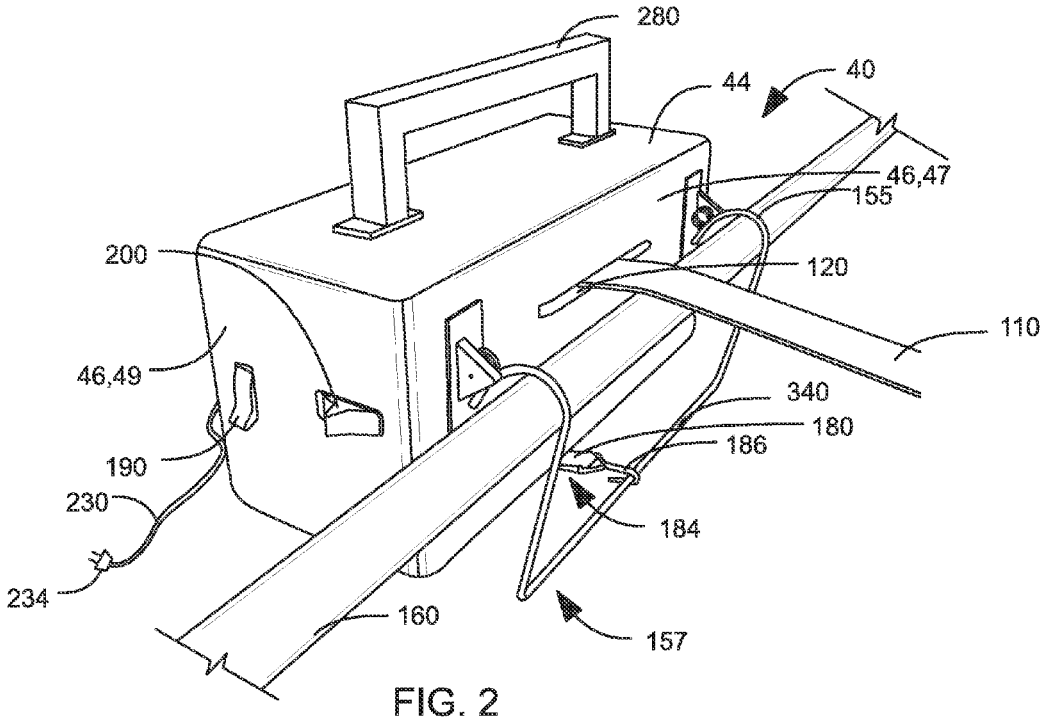
FIG. 2 is a partial perspective view of the invention, illustrating in more detail the enclosure of the invention.

Preferably the winch 10 further includes a bedrail hook 150 attached to the front wall 47, the hook 150 comprising at least one rigid U-shaped member 155 (FIG. 8). As such, the enclosure 40 may be fixed to a bedrail 160 of a bed 170 to move the patient 20 laying on the pad 30 on the bed 170 (FIGS. 3-7). A stability strap 180 is preferably included that is attached at one end 182 thereof to the enclosure 40, and attached at the other end 184 thereof to a hook 186. As such, the hook 186 may be engaged to the U-shaped member 155 to secure the U-shaped member around the bedrail 160 (FIG. 2). Each U-shaped member 155 may be connected to each other U-shaped member 155 by a connector rod 340 fixed to the distal end 157 of each U-shaped member 155. Preferably the at least one U-shaped member 155 includes exactly two U-shaped members 155, as illustrated in FIGS. 1 and 2). The U-shaped members 155 may be spring-biased against the enclosure 40, such as by including a spring at a pivot point where each U-shaped member 155 is fixed to the front wall 47. As such, the enclosure 40 may be fixed to the bedrail 160 of the bed 170 by pulling each U-shaped member 155 away form the enclosure 40 momentarily to position each U-shaped member 155 around the bedrail 160. Upon releasing the U-shaped members the spring urges each U-shaped member 155 back against the enclosure 40 to retain the bedrail 160 therebetween.

The stability strap 180 holds the enclosure to the bedrail 160 while the winching mechanism 60 is operating, and is preferably made from a strong nylon or other flexible yet strong material. The stability strap 180 may be somewhat elastic, as well, so as to provide additional spring force of the U-shaped members against the enclosure 40.

In addition to the enclosure 40 being mountable to the bedrail 160, the rear wall 48 may include a pair of mounting apertures 250 for mounting the enclosure 40 to a support 260 having corresponding mounting bolts 270, the support 260 being a rigid unmovable object such as a wall or the like, and the mounting bolts 270 being sheet metal screws with heads, or the like (FIG. 8). Alternately, the enclosure 40 may be removably mounted upon a wheeled cart (not shown) that includes locking wheels and, in use, is braced against the bed 170 so as to not move while moving the patient 20.

Figure 10:
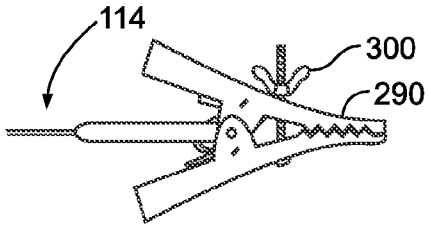
FIG. 10 is a partial elevational view of one embodiment of a clamping means of the present invention.

A winching strap 110 is connected at one end 112 thereof to the spool means 100. The winching strap 110 traverses an aperture 120 in the at least one side wall 46 of the enclosure 40, and a distal end 114 of the winching strap 110 terminates in a pad clamping means 130. The pad clamping means 130 is preferably a clamping bar 132 having at least two clamps 135, such that the pulling force pulling the clamping means is distributed substantially equally across each clamp 135. In one embodiment of the invention, each clamp 135 is a spring-biased alligator-type clamp 290. A manually actuable clamp screw 300 may be included with each alligator-type clamp for securely clamping the clamp 290 onto the pad 30 (FIG. 10).

Figure 11:
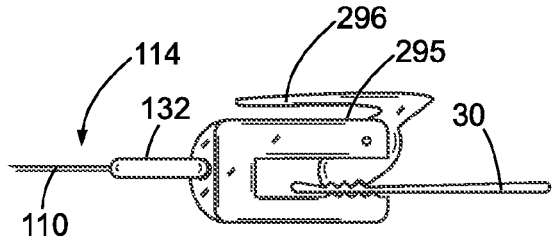
FIG. 11 is a partial elevational view of an alternate embodiment of the clamping means of the present invention.
Figure 12:
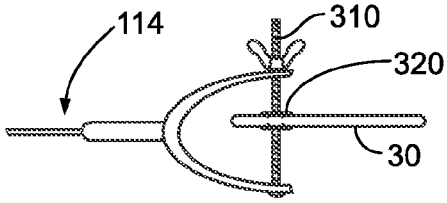
FIG. 12 is a partial elevational view of another alternate embodiment of the clamping means of the present invention.
Figure 6:
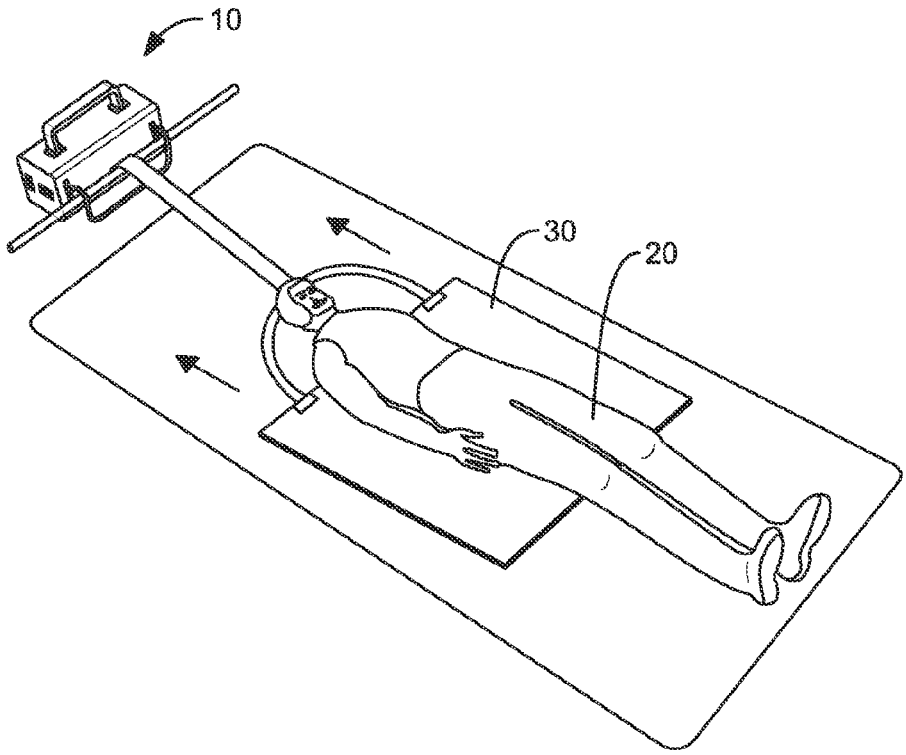
FIG. 6 is a top plan view of the invention, illustrating a patient to be moved from one position on the bed to another position by the present invention.
Figure 7:
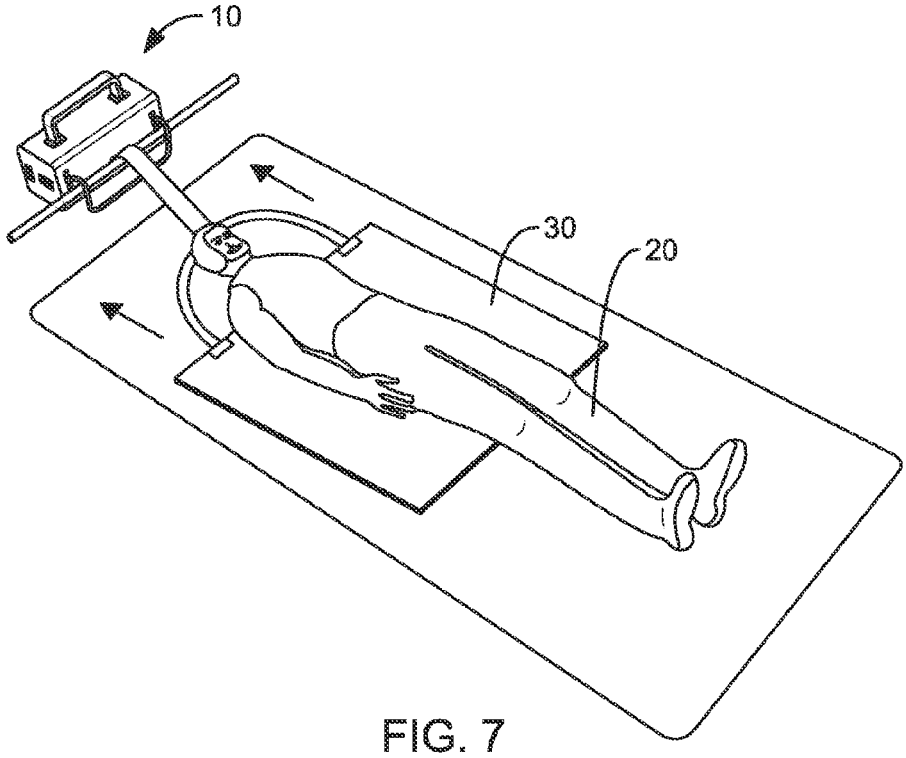
FIG. 7 is a top plan view of the invention, illustrating the patient as having been moved from the one position to the other position on the bed by the invention.

Preferably, however, each clamp 135 is a cam-based clamp 295 whereby the clamp 295 is tightened further upon the pad 30 when the clamp 295 is pulled by the winching mechanism 60 towards the enclosure 40 (FIG. 11). The pad 30 is released when the winching mechanism 60 is deactivated and a lever 296 of the clamp 295 is actuated to release the pad 30.

In yet another embodiment of the invention, the clamp 135 includes a through-bolt 310 for securing the clamp 135 to the pad 30 mechanically, the pad 30 in this embodiment including at least one reinforced eyelet 320 for receiving the through-bolt 310.

In use, the pad clamping means 130 is clamped firmly to the pad 30, and with the enclosure 40 secured to a non-movable object 140, the winching mechanism 60 may be activated by applying power thereto to retract the winching strap 110 around the spool means 100. As a result, the patient 20 is moved along a bed 170 or the like (FIGS. 3-6). The winching strap 110 may be extracted from the enclosure 40 by activating the switch 200 to draw-out the winching strap 110 in the forward direction 210. The reverse direction 220 is used to pull the patient 20 towards the winch 10.

While a particular form of the invention has been illustrated and described, it will be apparent that various modifications can be made without departing from the spirit and scope of the invention. For example, the type of winching mechanism 60 may be altered to any suitable winch means known in the art. Likewise, a variety of enclosure clamping means may be used as is known in the art. Accordingly, it is not intended that the invention be limited, except as by the appended claims.

What is claimed is:

1. A winch for moving a patient laying on a pad, comprising:

an enclosure comprising a bottom wall, a top wall, and at least one side wall, the walls defining an internal space within the enclosure;

a winching mechanism fixed within the enclosure and including a power means, a motor, a gearing means, a power switching means and a spool means;

a winching strap connected at one end thereof to the spool means, the winching strap traversing an aperture in the at least one side wall of the enclosure, a distal end of the winching strap terminating in a pad clamping means;

a bedrail hook attached to the at least one side wall, the hook comprising at least one rigid U-shaped member, and a stability strap attached at one end thereof to the enclosure and attached at the other end to a hook, whereby the hook may engage the U-shaped member to secure the U-shaped member around the bedrail;

whereby with the pad clamping means of the winching strap clamped firmly to the pad, and with the enclosure secured to a bedrail of a bed, the winching mechanism may be activated by applying power thereto to retract the winching strap around the spool means, thereby moving the patient.

2. The winch of claim 1 wherein the power switching means includes an on/off power switch, a three-way momentary direction switch, the momentary direction switch normally being in an off position and providing for momentarily powering of the motor in either a forward or reverse direction.

3. The winch of claim 1 wherein the power means is an electric power cable terminating at a distal end in an pronged outlet plug, and wherein the winching mechanism is powered by AC line power.

4. The winch of claim 3 further including an electric power cable holder projecting from the at least one side wall of the enclosure.

5. The winch of claim 1 wherein the top wall further includes a carrying handle projecting outwardly therefrom, the carrying handle adapted to support the weight of the winch when the winch is being carried thereby.

6. The winch of claim 1 wherein the pad clamping means includes a pair of clamps, the clamps each comprising a cam-type clamp, whereby with the pad secured within the clamp the clamp tightens down further on the pad when the clamp is pulled by the winching mechanism towards to the enclosure.

7. The winch of claim 1 wherein the pad clamping means includes a pair of spring biased alligator-type clamps.

8. The winch of claim 7 wherein each clamp further includes a manually actuable clamp screw for securely clamping the clamp onto the pad.

9. The winch of claim 1 wherein the pad clamping means includes a through-bolt for securing the clamping means to the pad, the pad having at least one eyelet for receiving the through-bolt.

10. The winch of claim 1 wherein the gearing means is a worm gear fixed to the spool means and a worm fixed to a shaft of the motor, the motor positioned to drive the worm gear in either a forward or reverse direction.

11. The winch of claim 1 wherein each at least one rigid U-shaped member is spring biased against the enclosure, whereby the enclosure may be fixed to the bedrail of the bed by pulling each U-shaped member away from the enclosure momentarily to position each U-shaped member around the bedrail, and then releasing the U-shaped member to spring back towards the enclosure and thereby retaining the bedrail therebetween.

12. The winch of claim 11 wherein the at least one rigid U-shaped member includes exactly two U-shaped members, each connected by a connector rod at a distal end thereof.

13. A winch for moving a patient laying on a pad, comprising:

an enclosure comprising a bottom wall, a top wall, and at least one side wall, the walls defining an internal space within the enclosure, the at least one side walls of the enclosure comprising a front wall, a rear wall, and two lateral walls, each wall joined to two of the other walls, the rear wall including a pair of mounting apertures for mounting the enclosure to a support having corresponding mounting bolts;

a winching mechanism fixed within the enclosure and including a power means, a motor, a gearing means, a power switching means and a spool means;

a winching strap connected at one end thereof to the spool means, the winching strap traversing an aperture in the at least one side wall of the enclosure, a distal end of the winching strap terminating in a pad clamping means, the front wall of the enclosure including an aperture through which a winching strap traverses;

whereby with the pad clamping means of the winching strap clamped firmly to the pad, and with the enclosure secured to the support, the winching mechanism may be activated by applying power thereto to retract the winching strap around the spool means, thereby moving the patient.

* * * * *